United States Patent [19]

Murata

[11] 4,250,523

[45] Feb. 10, 1981

[54] ELECTRONIC TIMEPIECE

[75] Inventor: Masami Murata, Suwa, Japan

[73] Assignee: Kabushiki Kaisha Suwa Seikosha, Tokyo, Japan

[21] Appl. No.: 9,724

[22] Filed: Feb. 5, 1979

[30] Foreign Application Priority Data

Feb. 3, 1978 [JP] Japan ..... 53/11689

[51] Int. Cl.[3] ..... G04C 3/00

[52] U.S. Cl. ..... 368/82; 368/84

[58] Field of Search ..... 58/44, 23 R, 50 R, 56 R, 58/58, 85.5; 235/92 T

[56] References Cited

U.S. PATENT DOCUMENTS 4,023,343 5/1977 Martinet ..... 58/23 R 4,094,136 6/1978 Aizawa ..... 58/23 R 4,150,537 4/1979 Mochizuki et al. ..... 58/23 R

*Primary Examiner*—Edith S. Jackmon

*Attorney, Agent, or Firm*—Blum, Kaplan, Friedman, Silberman & Beran

[57] ABSTRACT

An inspection circuit for use in an electronic timepiece is provided. The inspection circuit is characterized by the use of a gating circuit intermediate the timekeeping circuit of an electronic timepiece and certain counters that apply timekeeping signals to the digital display digits. The gating circuit is adapted to be selectively disposed into an inspection mode and thereby simultaneously apply to certain of the counters producing timekeeping signals a predetermined frequency inspection signal thereby reducing the time required to inspect the performance of the timepiece.

7 Claims, 1 Drawing Figure

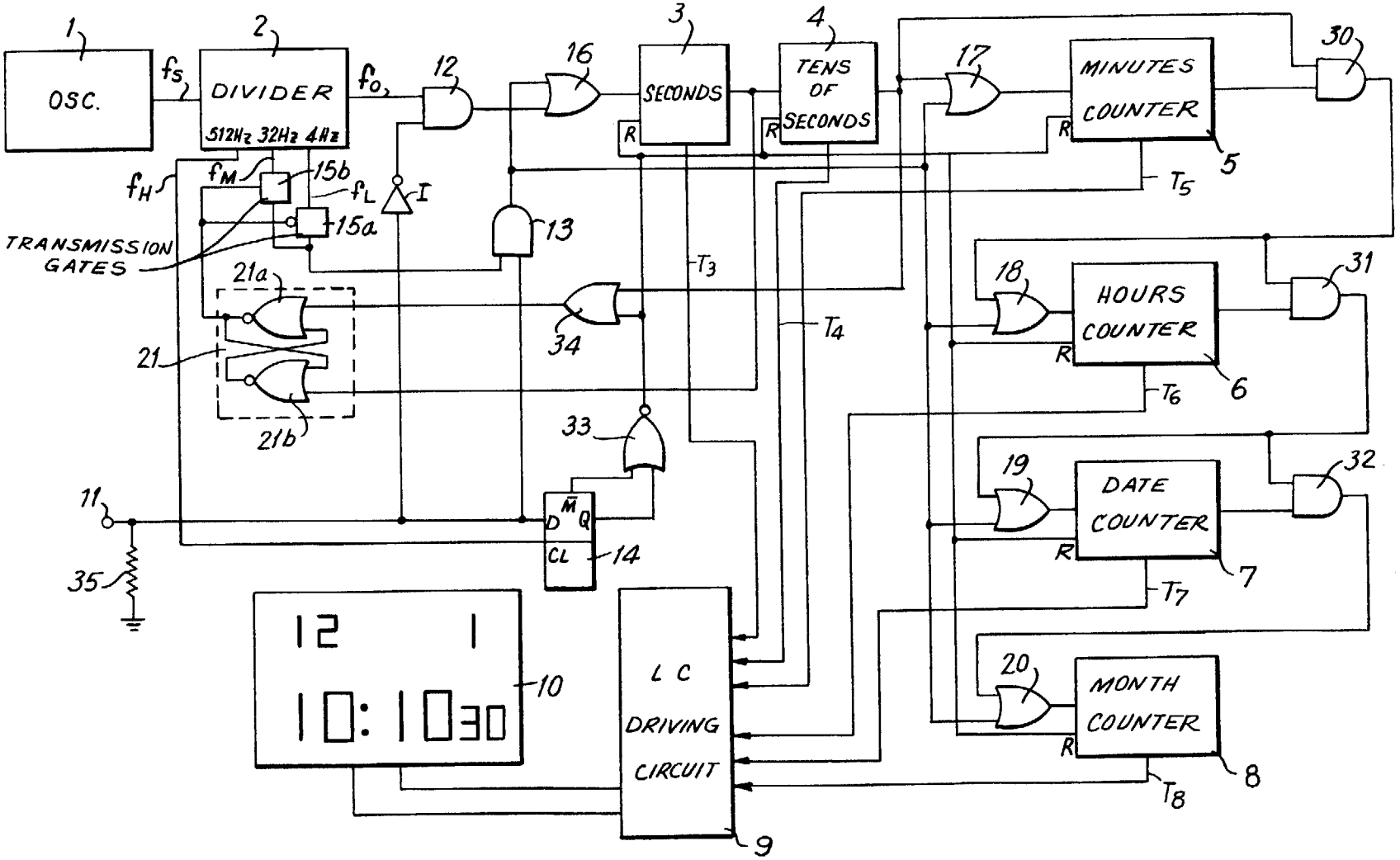
OSC.
DIVIDER
512Hz 32Hz 4Hz
SECONDS
TENS OF SECONDS
MINUTES COUNTER
HOURS COUNTER
DATE COUNTER
MONTH COUNTER
L C DRIVING CIRCUIT
TRANSMISSION GATES
12:10:30

ELECTRONIC TIMEPIECE

BACKGROUND OF THE INVENTION

This invention is directed to an inspection circuit for use in an electronic timepiece and, in particular, to an inspection circuit that permits each of the timekeeping counters in an electronic timepiece to be simultaneously inspected, and thereby shortens the time required to perform such inspection.

To the manufacturer of electronic timepieces, such as miniaturized electronic wristwatches and the like, quality control is deemed to be one of the most significant yet inefficient manufacturing operations. Heretofore, one typical method of performing quality control in an electronic wristwatch was to change over the electronic wristwatch from a normal display mode into a correction mode in order to inspect the operation of the timekeeping counters and the digital display digits. Specifically, in order to inspect the minutes display, the minutes display would be selected in a correction mode, and thereafter, sixty correction pulses would be applied thereto in order to index the minutes counter sixty times. Thereafter, the same operation would be repeated for the hours counters, date counter and month counter. By indexing each of the timekeeping counters when same are disposed in a correction mode, proper operation of the timekeeping counters and the digital display digits can easily be monitored.

It is noted, however, that this operation is highly inefficient. As the number of types of information displayed by electronic wristwatches has increased, the amount of time required to inspect an electronic wristwatch, in the manner detailed above, has likewise increased.

The inspection method detailed above is speeded up when the electronic wristwatch includes a rapid advance correction mechanism instead of the more widely utilized indexing type correction mechanisms. Specifically, in rapid advance correction mechanisms, an intermediate frequency signal higher than the usual one second low frequency timing signal applied to the seconds counter is applied to the specific timekeeping counter selected for correction and, hence, rapidly advances the count thereof. Although this type of rapid advance correction does increase the time of inspection it is still necessary to sequentially select each of the counters for correction and, furthermore, manufacturers often prefer to utilize the indexing type correction which is often favored by consumers. Accordingly, an inspection circuit for use in electronic timepieces that significantly decreases the time required to inspect the timekeeping counters and digital display elements during a quality control operation is desired.

SUMMARY OF THE INVENTION

Generally speaking, in accordance with the instant invention, an inspection circuit for use in an electronic timepiece is provided. The electronic timepiece includes a timekeeping circuit for producing a low frequency timing signal and at least one intermediate frequency signal. A plurality of series-connected timekeeping counters are each adapted to produce timekeeping signals, representative of timekeeping information, in response to the low frequency timing signal being applied thereto. Display digits are coupled to the plurality of series-connected timekeeping counters for displaying timekeeping information in response to the timekeeping signals produced by the timekeeping counters. The inspection circuit is particularly characterized by a gating circuit coupled intermediate the timekeeping circuit and each of the timekeeping counters, the gating circuit being normally disposed in a timekeeping mode to thereby permit the low frequency timing signal to be applied to the series-connected timekeeping counters. A control circuit is coupled to the gating circuit for selectively disposing the gating circuit from a timekeeping mode to an inspection mode. The gating circuit, in response to being disposed in an inspection mode is adapted to simultaneously apply to each of the timekeeping counters the intermediate frequency signal produced by the timekeeping circuit and thereby simultaneously inspect each of the timekeeping counters and display digits coupled thereto.

Accordingly, it is an object of the instant invention to provide an improved inspection circuit for an electronic timepiece.

A further object of the instant invention is to provide an improved inspection circuit for an electronic timepiece that does not require disposing the electronic timepiece in a correction mode to perform an inspection operation.

Still a further object of the instant invention is to provide an improved inspection circuit for an electronic timepiece wherein an inspection signal is simultaneously applied to each of the timekeeping counters to be inspected, to thereby effect a highly efficient inspection of the timekeeping counters and display digits associated therewith.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWING

For a fuller understanding of the invention, reference is had to the following description taken in connection with the accompanying drawing, in which:

The FIGURE is a block circuit diagram of an inspection circuit for use in an electronic timepiece constructed in accordance with a preferred embodiment of the instant invention.

DETAILED DESCRIPTION OF THE PREFERRED EMBODIMENT

Reference is now made to the drawing, wherein an inspection circuit, for use in a quartz crystal digital display electronic wristwatch, is depicted. As is explained in greater detail below, the electronic timepiece includes the usual timekeeping circuit, counter circuits, display driving circuit, and digital display found in conventional electronic wristwatches, which components are described in detail in order to facilitate an understanding of the instant invention.

The timekeeping circuit includes an oscillator circuit 1 having a quartz crystal vibrator (not shown) that vibrates at a high frequency $2^{16}$ Hz. Specifically, by coupling a high frequency quartz crystal vibrator, capable of vibrating at frequencies on the order of $2^{16}$ Hz to a C-MOS oscillator circuit, the oscillator circuit will produce a high frequency time standard signal $f_S$ having substantially the same frequency as the vibrational frequency of the quartz crystal vibrator.

The high frequency time standard signal $f_S$ is applied to a divider 2 comprised of a plurality of series-connected binary divider stages, which stages divide down the high frequency time standard signal and produce a one second low frequency timing signal $f_O$. It is noted that if the high frequency time standard signal is on the order of $2^{16}$ Hz, the divider circuit 2 will be provided with sixteen series-connected binary divider stages in order to produce a low frequency timing signal having a frequency of 1 Hz. As will be demonstrated below with respect to the inspection circuit, the binary divider stages, forming the divider circuit 2, are capable of producing intermediate frequency signals such as signal $f_L$, $f_M$ and $f_H$ respectively having a frequency of 4 Hz, 32 Hz and 512 Hz, to be utilized by the inspection circuit in order to obtain the objects of the instant invention.

The electronic wristwatch circuit, depicted in the drawing, further includes a plurality of series-connected timekeeping counters including seconds counter 3, tens of seconds counter 4, minutes counter 5, hours counter 6, date counter 7 and month counter 8. It is noted that AND gates 30, 31 and 32 are respectively disposed intermediate the minutes, hours and date counters for performing the transmission of timing signals between the respective series-connected counters. These counters are operated in response to the low frequency timing signal $F_O$ being applied to the seconds counter 3. Specifically, as the low frequency timekeeping signal $f_O$ is applied to the seconds counter 3, the seconds counter is cycled through a count of 10 and, in response to a full counting cycle thereof, the seconds counter 3 will apply a pulse to the tens of seconds counter 4. The tens of seconds counter 4 will thereby be indexed every ten seconds by the seconds counter 3 and, at the end of a full counting cycle of six, will apply a pulse through OR gate 17 to minutes counter 5 to thereby index the count of minutes counter 5. Thus, by applying the low frequency timing signal $f_O$ to the seconds counter 3, each of the series-connected timekeeping counters are continually indexed and provide a timekeeping operation. Moreover, as each of the seconds counter 3, tens of seconds counter 4, minutes counter 5, hours counter 6, date counter 7 and month counter 8 are indexed through a complete counting cycle, they produce timekeeping signals $T_3$, $T_4$, $T_5$, $T_6$, $T_7$ and $T_8$ to an LC driving circuit 9, which circuit is coupled to a conventional liquid crystal display panel 10. Thus, the liquid crystal display digits, in response to the timekeeping signal produced by the timekeeping counters, display the count thereof, which count represent actual time. It is noted that the liquid crystal display digits are conventionally formed of seven liquid crystal display segment digits, which segment digits are selectively lit in order to display numerical information.

Accordingly, when manufacture of the timepiece is completed, and a quality control inspection operation is to be performed, it is necessary to determine first, if each of the timekeeping counters are properly operating and, secondly, if the display digits are properly displaying the counts of the timekeeping counters. In order to perform this operation, the instant invention provides an inspection circuit whereby a plurality of intermediate frequency signals are applied in parallel to the series-connected timekeeping counters in order to permit each of the counters and liquid crystal display digits associated therewith to be simultaneously monitored.

The inspection circuit of the instant invention includes a control circuit comprised of a control input terminal 11 and differentiator circuit 14, for disposing the inspection circuit in an inspection mode. Specifically, control circuit 11 is coupled to a source of binary pulses and has applied thereto either a HIGH binary level pulse or a LOW binary level pulse. The control input terminal 11 is coupled to resistor 35, to the D input of differentiator flip-flop 14, to a first input of AND gate 13 and through an inverter gate I to a second input of AND gate 12. Accordingly, when the inspection circuit is to be disposed in an inspection mode, a HIGH level binary signal is applied to the control input 11. Specifically, in response to a HIGH level binary signal being applied to control input 11, the inverter I applies a LOW binary level signal to the second input of AND gate 12 to thereby inhibit the application of the low frequency timing signal $f_O$ to OR gate 16.

The HIGH level control signal is also applied to the D terminal of differentiator circuit 14, which circuit also receives a 512 Hz intermediate frequency signal $f_H$ at the clock input CL thereof. Accordingly, differentiator circuit 14 will apply a HIGH level output Q and a LOW level output $\bar{M}$ and thereby apply a HIGH level reset signal R to each of the timekeeping counters 3 through 8. Thus, in response to the HIGH level binary signal, produced at the control input terminal 11, each of the timekeeping counters are reset to a count of zero, and since the AND gate is continuing to inhibit the low frequency timing signal from being applied therethrough to the seconds counter 3, the timekeeping counters remain reset and are not counting.

Also, in response to the HIGH level reset signal being produced at the output of EXCLUSIVE NOR gate 33, OR gate 34 applies a SET signal to NOR gate **21*a*, which NOR gate, in combination with NOR gate 21*b*, defines a set-reset latch circuit 21. In response to a SET signal being applied to latch circuit 21 by OR gate 34, the latch circuit applies a HIGH level signal through the NOT input of transmission gate 15*a* to thereby turn transmission gate 15*a* ON and permit the 4 Hz intermediate frequency signal $f_L$ to be applied therethrough to the first input of AND gate 13. The second input of AND gate 13, as aforenoted, is coupled to the control input terminal 11 and, in view of the HIGH level binary signal being applied thereto, effects a transmission of the intermediate frequency signal $f_L$ to the inputs of OR gates 16, 17, 18, 19 and 20 respectively coupled to the inputs of the seconds, tens of seconds, minutes, hours, date and month counters. Thus, in response to transmission gate 15*a*** being turned ON, the 4 Hz intermediate frequency signal $f_L$ is simultaneously applied in parallel to each of the timekeeping counters to thereby rapidly advance same through a timekeeping cycle and permit each of the counters and display digits associated therewith to be simultaneously inspected.

It is, therefore, apparent that when inspection is being performed by having an intermediate frequency signal simultaneously applied to each of the timekeeping counters, the time required to inspect each of the counters is the time required to apply a sufficient number of pulses to index same through one counting cycle. Since the number of pulses required for inspecting the seconds and minutes counters is sixty, the time required to effect inspection of the entire electronic wristwatch, illustrated in the drawing, using the 4 Hz intermediate frequency signal would be fifteen seconds ($60/4=15$). Thus, if a single seconds and tens of seconds counter, having a counting cycle of sixty were used, a single intermediate frequency signal, such as $f_L$, could be used to effect inspection of each of the counters. It is noted, however, that if, as illustrated in the drawing, a unit of seconds counter 3 and tens of seconds counter 4 is used, or possibly each of the timekeeping counters are divided into unit and tens of units, such as minutes and tens of minutes, once the units counters are cycled through a count of 0 to 9, any time utilized thereafter for inspecting the units digits would be wasted.

Accordingly, as a further embodiment of the instant invention, the inspection circuit utilizes the output of units seconds counter in order to change the frequency of the inspection signal simultaneously applied to the timekeeping counters to effect inspection thereof. Specifically, as detailed above, when the HIGH binary control signal is applied to the control input terminal 11, the seconds counter 3 is initially reset to zero and then receives the 4 Hz intermediate frequency signal and is rapidly indexed through its full counting cycle of ten. Therefore, when ten clock pulses are applied to the units seconds counter 3, the pulse that is produced thereby is applied to the reset terminal of NOR gate **21*b* of latch circuit 21 as a RESET signal in order to reset same, and apply a LOW level signal to transmission gate 15*b* and thereby turn same ON and transmission gate 15*a* OFF. In response to being turned ON, transmission gate 15*b* applies the 32 Hz intermediate frequency signal through transmission gate 15*b*, AND gate 13 and OR gates 16 through 20 to the timekeeping counters in the same manner previously discussed with respect to the 4 Hz intermediate frequency signal $f_L$. In response to the 32 Hz signal, the display is advanced at eight times the speed previously discussed, thereby permitting the tens of digits of the seconds, minutes, hours, date and month counters to be quickly inspected. Specifically, after sixty clock pulses are applied to the seconds counter 3, a pulse will be produced at the output of tens of seconds counter 4 and will cause a SET signal to be applied to latch circuit 21** and, hence, once again return the inspection signal from a 32 Hz signal to a 4 Hz signal.

Thus, one embodiment of the instant invention is particularly characterized by the use of clock signals having a suitable frequency such as 32 Hz and 4 Hz for inspection, which signals are normally produced by the timekeeping circuit during frequency division of the high frequency time standard signal $f_S$. The instant invention clearly reduces the number of circuit elements required to effect inspection. The only circuit elements that would be necessary to perform inspection by two intermediate frequency inspection signals are AND gates 12 and 13, differentiation circuit 14, transmission gates **15*a* and 15, OR gates 16 and 20 and latch circuit 21**, so that the number of circuit elements required to effect inspection is on the order of seventy whereas the number of elements included in an electronic wristwatch, of the type illustrated in the drawing, is on the order of 3,000 to 4,000 elements. By increasing the number of elements in an electronic wristwatch by slightly more than two percent, the speed with which the timepiece can be inspected is rapidly increased. Moreover, as the number of timekeeping operations and functions performed by electronic wristwatches increases, the number of elements required to perform the inspection detailed herein become less significant.

Accordingly, the instant invention is particularly characterized by a simplified inspection circuit wherein an intermediate frequency inspection signal is simultaneously applied in parallel to each of the timekeeping counters to permit same to be inspected at the same time. It is, therefore, noted that the time required to perform inspection by simultaneously applying intermediate frequency inspection signals to each of the timekeeping counters is sharply reduced from that obtained when each of the timekeeping counters are first disposed in a correction mode and then inspected in sequence, in the manner detailed above. It is further noted that as used herein, the term "timekeeping counter" refers to either a single counter for a particular interval of time, such as the minutes counter illustrated in the drawing, or a pair of counters for counting units and tens of units, such as the second and tens of seconds counters, illustrated in the drawing.

It will thus be seen that the objects set forth above, among those made apparent from the preceding description, are efficiently attained and, since certain changes may be made in the above construction without departing from the spirit and scope of the invention, it is intended that all matter contained in the above description of shown in the accompanying drawing shall be interpreted as illustrative and not in a limiting sense.

It is also understood that the following claims are intended to cover all of the generic and specific features of the invention herein described and all statements of the scope of the invention which, as a matter of language, might be said to fall therebetween.

What is claimed is:

1. An inspection circuit for use in an electronic timepiece including timekeeping circuit means for producing a low frequency timing signal and at least one intermediate frequency signal, a plurality of series-connected counter means adapted in response to said low frequency timing signal to be applied to said first series-connected counter means to each produce timekeeping signals representative to timekeeping information and display digit means coupled to said plurality of series-connected counter means for displaying timekeeping information in response to the timekeeping signals being applied thereto; the improvement comprising gating means coupled intermediate said timekeeping circuit means and each of said timekeeping counter means, said gating means being normally disposed in a timekeeping mode to permit said low frequency timing signal to be applied to said first series-connected counted means and control means coupled to said gating means for selectively disposing said gating means from a timekeeping mode to an inspection mode, said gating means being adapted in an inspection mode to simultaneously apply to each of said counter means said intermediate frequency signal produced by said timekeeping circuit means to thereby permit each of said counter means to be simultaneously inspected, said control means further including reset means coupled to each of said series-connected counter means, said reset means being adapted to reset each of said counter means when said control means selectively disposes said gating means into an inspection mode.

2. An inspection circuit as claimed in claim 1, wherein said gating means includes inhibit means for inhibiting said low frequency timing signals from being applied to said series-connected counter means in response to said gating means being selectively disposed in said inspection mode.

3. An inspection circuit as claimed in claim 2, wherein said inhibit means includes an inhibit logic gate disposed intermediate said timekeeping circuit means and said first series-connected counter means for normally transmitting said low frequency timing signal to said series-connected counter means, said inhibit logic gate being adapted to be disposed into an inspection mode and thereby inhibit the application of said low frequency timing signals to said first series-connected counter means.

4. An inspection circuit as claimed in claim 1, wherein said gating means includes an inhibit gate adapted to receive said intermediate frequency signal produced by said timekeeping circuit means, said inhibit gate being adapted to prevent said intermediate frequency signals from being applied to said series-connected counter when said logic gate means is disposed in a normal timekeeping mode, said inhibit gate being adapted, in response to said logic gate means being disposed in an inspection mode, to transmit said intermediate frequency signal to each of said series-connected counter means.

5. An inspection circuit as claimed in claim 2, wherein at least one of said series-connected counter means includes first and second series-connected counters each producing timekeeping signals, each of said first and second timekeeping counters having a distinct counting cycle, said timekeeping circuit means being adapted to produce a second intermediate frequency signal having a frequency higher than said first intermediate frequency signal and said gating means being adapted when disposed in an inspection mode to apply said first intermediate frequency signal to said first counter of said counter means and, in response to detecting said first counter being counted through a full counting cycle, being adapted to apply said second intermediate frequency signal to said first counter to thereby more rapidly advance said first and second counters through their full counting cycles.

6. An inspection circuit, as claimed in claim 5, wherein said gating means includes a selection circuit, said selection circuit being adapted in response to said reset signal being applied thereto, to apply said first intermediate frequency signal to said first timekeeping counter, said selecting circuit being coupled to the output of said first timekeeping counter and in response to detecting same being counted through a full cycle thereof in response to said first frequency intermediate frequency signal being applied thereto, being adapted to select said second intermediate frequency signal and apply same to said first timekeeping counter, said selection circuit being further coupled to said second timekeeping counter for detecting the counting of same through a full cycle in response to said second intermediate frequency signal being applied thereto and in response to detecting the counting of same through a full counting cycle, said selection circuit being adapted to once again apply said first intermediate frequency signal to said first timekeeping counter.

7. An inspection circuit as claimed in claim 6, wherein said first timekeeping counter is a seconds counter and said second timekeeping counter is a tens of seconds counter.

* * * * *